United States Patent [19]

Koyasu et al.

[11] Patent Number: 4,806,178

[45] Date of Patent: Feb. 21, 1989

[54] NON-HEAT REFINED STEEL BAR HAVING IMPROVED TOUGHNESS

[75] Inventors: Yoshiro Koyasu; Yutaka Tsuchida; Nobukazu Suzuki, all of Muroran, Japan

[73] Assignee: Nippon Steel Corporation, Tokyo, Japan

[21] Appl. No.: 942,960

[22] Filed: Dec. 16, 1986

Related U.S. Application Data

[63] Continuation of Ser. No. 751,193, Jul. 2, 1985, abandoned.

[30] Foreign Application Priority Data

Jul. 4, 1984 [JP] Japan ..... 59-138276
Dec. 12, 1984 [JP] Japan ..... 59-260839

[51] Int. Cl.[4] ..... C22C 38/28
[52] U.S. Cl. ..... 148/330; 148/333
[58] Field of Search ..... 148/333, 330, 12; 420/104, 120

[56] References Cited

U.S. PATENT DOCUMENTS 4,388,122 6/1983 Sudo et al. ..... 148/333
4,472,208 9/1984 Kunishige ..... 148/36
4,537,644 8/1985 Tominaga et al. ..... 75/126 D

FOREIGN PATENT DOCUMENTS 54-9966 4/1979 Japan ..... 148/36
55-82749 6/1980 Japan .
55-89432 7/1980 Japan ..... 148/36
6130456 10/1981 Japan ..... 148/36
0715638 2/1980 U.S.S.R. ..... 148/36

*Primary Examiner*—Deborah Yee
*Attorney, Agent, or Firm*—Kenyon & Kenyon

[57] ABSTRACT

Improved toughness of forging is obtained without quenching and tempering by controlling the steel composition to: 0.05% to less than 0.15% C.; 0.10–1.00% Si; 0.50–3.00% Mn; 1.60–4.20% Mn+Cr; 0.010–0.030% Ti; 0.005–0.0030% B; 0.01–0.05% Al; and 0.0060% or less of N.

2 Claims, 2 Drawing Sheets

NON-HEAT REFINED STEEL BAR HAVING IMPROVED TOUGHNESS

This application is a continuation of application Ser. No. 751,193, filed July 2, 1985, now abandoned.

BACKGROUND OF INVENTION

1. Field of Invention

The present invention relates to non-heat treated steel which can exhibit improved toughness in an ascooled state without being subjected to quenching and tempering treatments and which can be used as a material for producing mechanical parts.

2. Description of the Related Art

Mechanical parts such as automobile parts are usually produced from steel bar by hot-forging, quenching and tempering treatments followed by machining. In the production of such parts, from the viewpoint of energy conservation and a reduction in the production cost of the parts, direct quenching after forging using the heat remaining after hot-forging or non-heat treated steel, wherein precipitation hardening of V, Nb or the like is utilized, is widely known as a technique omitting heat treatment (e.g., Automobile Technique, Vol. 37, No. 3, p 242, 1983, or Japanese Unexamined Patent Publication (Kokai) No 55-82749). However, the non-heat treated steel to which V, Nb or the like is added, i.e., in which a so-called micro alloying technique is utilized exhibits low toughness, because of coarse grained ferrite-pearlite structure in an as-spontaneously-cooled state after hot forging, due to the character of the form in practical use, and therefore, that type of steel is limited in the scope of practical application. Thus, at present, the non-heat treated steel is not used as a material for important safety-preservation parts an automobile, e.g., the suspension and associated members thereof.

The toughness of this conventional non-heat treated steel is variable depending on the size of the part, the desired level of strength, the forging method and conditions and the like. Usually, the impact value determined at 25° C. using an impact specimen according to JIS No. 3 is as low as 5 kg-m/cm$^2$ or less. The toughness can be increased by reducing the heating and finishing temperatures during the forging, so as to refine the crystal grains. However, this temperature reduction involves problems such as the life of the forging dies and the degree of filling in of the dies.

SUMMARY OF THE INVENTION

It is an object of the present invention to eliminate the above-mentioned problems and provides non-heat treated steel which exhibits improved toughness in the as-hot-forged and then cooled state.

In accordance with the object of the present invention there is provided non-heat treated steel which exhibits improved toughness, which steel consists of, on a weight basis, from 0.05% to less than 0.18% if C, from 0.10% to 1.00% of Si, from 0.50% to 3.00% of Mn, from 1.60% to 4.20% of Cr+Mn, from 0.010% to 0.030% of Ti, from 0.0005% to 0.0030% of B, from 0.01% to 0.05% of Al, and not more than 0.0060% of N, the balance consisting essentially of Fe.

Since the steel of the present invention has chemical composition such that the structure of the matrix itself is a bainite structure having high toughness, the hot-working conditions for producing automobile parts need not be strictly controlled and conventional heating conditions may be applied to the hot-working process. The toughness should be attained under the forged and then cooled state, the cooling being at a speed of spontaneous cooling or a higher speed. Attention should be paid to the cooling condition after forging. After the forging process is completed, the resultant parts should be cooled individually, e.g., on a conveyor by spontaneous cooling or air cooling, taking care not to allow the parts to be in contact with each other by separating them one by one.

One cooling method in accordance with the present invention is a spontaneous cooling, i.e., cooling in still air, in which the cooling may be carried out at a cooling rate of 120° to 12° C./min over the transformation range.

The other cooling method after hot-forging is cooling in hot water. This can be stably carried out by providing a simple quenching vessel behind the hot-forging machine, first raising the water temperature to 95° C. or more, and subsequently, charging the forged products continuously into the quenching vessel to cool them. This cooling method is particularly suitable for existing production lines in which quenching is carried out immediately after hot-forging. In this case, water can be used instead of a quenching oil.

The steel composition of present invention will now be described in detail below.

Carbon is an important element for determining the strength of the product. If the carbon content is less than 0.05%, the amount of the alloying elements necessary to obtain the required strength becomes excessively large, which is unfavorable from an economical point of view. Therefore, the carbon content should be at least 0.05%. On the other hand, if the carbon content exceeds 0.18%, the strength is too high, and the toughness and machinability properties are degraded. Therefore, the highest carbon content should be 0.18%. A preferred carbon content for hot-water cooled forgings is from 0.06 to 0.15%.

Silicon is an element necessary for deoxidation, and the silicon content should be at least 0.10%. When the silicon content exceeds 1.00%, the steel has a higher strength than necessary. Therefore, the highest silicon content should be 1.00%.

Manganese is an element for controlling deoxidation and the strength and toughness of the product together with carbon and chromium. Moreover, manganese is necessary for preventing the steel embrittlement during hot working by combining with sulfur contained in the steel. For these purposes, the manganese content should be at least 0.50%. When the mangenese content exceeds 3.00%, the machinability is reduced and difficulties in steel making are increased. Therefore, the highest manganese content should be 3.00%. A preferred manganese content for hot-water cooled forgings is from 0.5 to 2.00%, and a preferred manganese content for spontaneously cooled forgings is from 0.6 to 3.0%.

Chromium is necessary for controlling the strength and toughness of the product together with carbon and manganese as described above. Chromium and manganese should be added in an amount of 1.60% to 4.20% in terms of Cr+Mn, with at least 0.67% being Cr. If the Cr+Mn content is less than 1.60%, the toughness is reduced. On the other hand, if the Cr+Mn content is more than 4.20%, the strength becomes too high. Therefore, the highest Cr+Mn content should be 4.20% By determining the Cr+Mn content in the range of from 1.60 to 4.20%, tensile strength of from 70 to 100 kg/mm² is obtained by spontaneous cooling, and by determining the Cr+Mn content in the range of from 2.00 to 4.00%, tensile strength of from 70 to 110 kg/mm² is obtained by hot-water cooling.

Titanium is necessary for fixing nitrogen so as to allow the boron described hereinafter to function effectively. A titanium content of less than 0.010% is unsatisfactory for fixing nitrogen. However, at a titanium content of 0.030%, the nitrogen fixing effect is saturated. Therefore, the titanium content should be at least 0.010% and at highest 0.030%.

Boron should be added in an amount of 0.0005% to 0.0030% in order to improve the hardenability of steel. If the boron content is less than 0.0005%, this effect is small. However, the boron effect is saturated at a level of 0.0030%. Therefore, the boron content should be at least 0.0005% and at highest 0.0030%.

Aluminum is necessary as a deoxidizing agent and a controller of crystal grains. The aluminum content should be in the range of from 0.01% to 0.05%. An aluminum content of less than 0.01% is unsatisfactory for deoxidation and for controlling crystal grains. On the other hand, if the aluminum content is more than 0.05%, any additional effect cannot be obtained, and such a large amount is uneconomical. Therefore, the highest aluminum content should be 0.05%.

When the nitrogen content is more than 0.0060%, the amount of titanium necessary to fix nitrogen is excessively large, and the toughness is reduced due to the presence of TiN. Therefore, the nitrogen content must not exceed 0.0060%.

Moreover, the addition of up to 0.07% of sulfur or up to 0.30% of lead is effective for improving the machinability.

DESCRIPTION OF THE PREFERRED EMBODIMENTS

The simulation experiments of hot-forging are now explained.

Specimens were prepared by melting 150 kg of steel consisting of, on a weight basis, from 0.05% to 0.20% of C, from 0.10% to 1.00% of Si, from 0.60% to 3.00% of Mn, from 1.00% to 4.00% of Cr, from 0.010% to 0.030% of Ti, from 0.0005% to 0.0030% of B, from 0.01% to 0.05% of Al, and not more than 0.0060% of N, the balance consisting essentially of Fe in a vacuum melting furnace, and subjecting the melt to forging to provide steel bars measuring from 30 mm to 50 mm in diameter. The steel bars were subjected to forging simulation experiments by heating to 1250° C. followed by cooling. Testpieces were prepared from thus-treated steel bars and were evaluated for mechanical properties.

The simulation test is consistent with the results of an actual forging test as shown in the examples described hereinafter. Therefore, the simulation test is considered a reasonable substitute.

Figure 1:
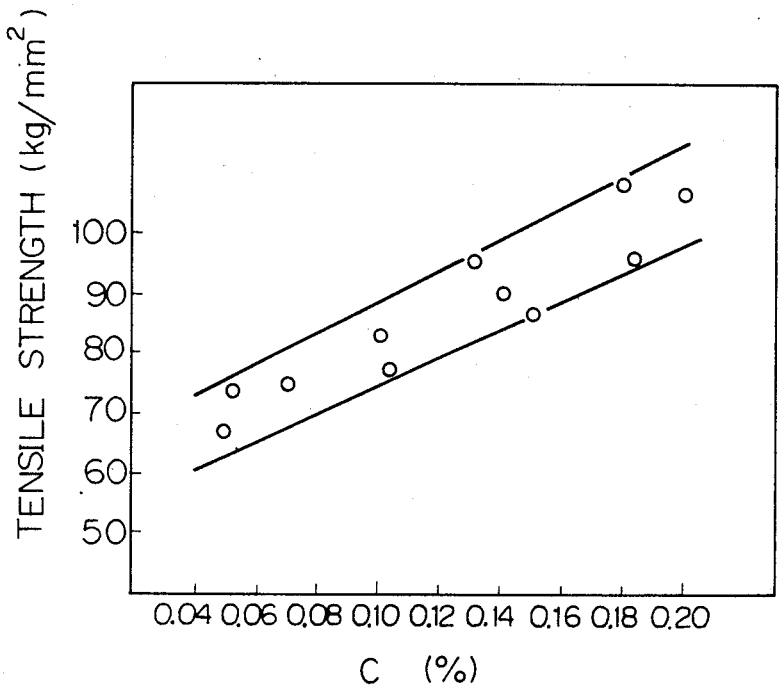
FIG. 1 is a graph showing the relationship between the carbon content of the steel of the present invention and the tensile strength.

From this simulation test was obtained the relationship between the C content in the steel and the tensile strength, as shown in FIG. 1. As the mechanical parts to which the present invention is directed have tensile strength of 70 to 100 kg/mm², it was found that the C content should be in the range of from 0.05% to 0.18%. Moreover, the present inventors investigated the effect of the contents of Cr and Mn. As a result, the regression formula (1) was obtained with regard to the tensile strength at the range of Cr+Mn≧1.50%:

$$\sigma_B(\text{kg/mm}^2)=400\times(\%C)+33\times[(\%Mn)+(\%Cr)]-56 \quad (1)$$

In order to obtain a tensile strength of 70 to 100 kg/mm² at the C content of 0.05% to 0.18%, it was found from formula (1) that the (Cr+Mn) content should be in the range of from 1.60% to 4.20%. The steel in the as-spontaneously-cooled state after hot forging exhibits tensile strength of 70 to 100 kg/mm² and impact value of 5 kg-m/cm² or more. Thus the present invention was accomplished.

Non-heat treated bar steel for hot-forging, according to the present invention, has improved toughness (10 kg-m/cm² or more in terms of impact value) equal to or higher than that of the quenched and tempered material of SCM435 steel, which is typical of steel having high toughness, and exhibits dramatically high toughness as compared with the conventional non-heat treated steel bar for hot-forging. The experiments for improving toughness are explained hereinafter.

Specimens were prepared by melting 150 kg of steel consisting of, on a weight basis, from 0.05% to 0.20% of C, from 0.10% to 1.00% of Si, from 0.50% to 2.00% of Mn, from 2.00% to 4.00% of Mn+Cr, from 0.01% to 0.03% of Ti, from 0.0005% to 0.0030% of B, from 0.01% to 0.05% of Al, and not more than 0.0060% of N, the balance consisting essentially of Fe, in a vacuum melting furnace, and subjecting the melt to forging to provide steel bar having a diameter of 30 mm.

Figure 2:
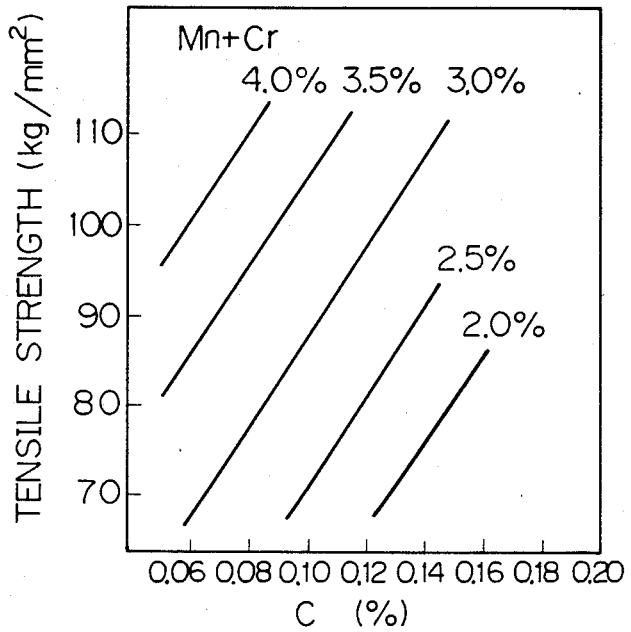
FIG. 2 is a graph showing the relationship between the carbon content of the steel of the present invention and the tensile strength; and, FIG. 3 is a graph showing the relationship between the carbon content of the steel of the present invention and the impact value.
Figure 3:
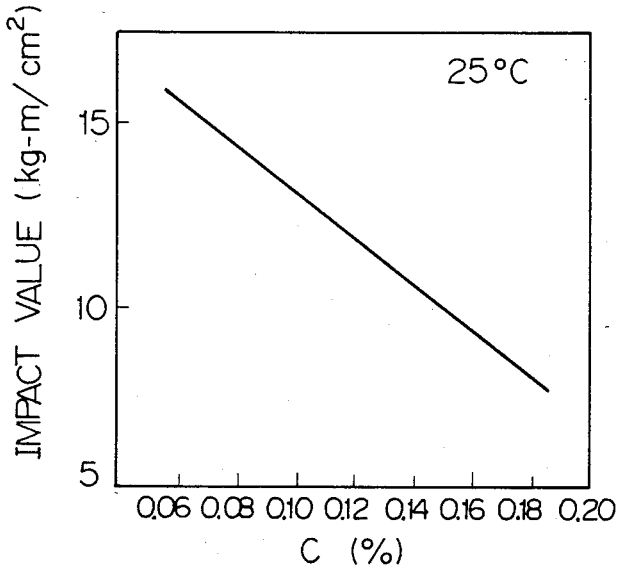

The steel bar thus produced was heated to 1250° C. and then cooled in hot water. Thereafter, a testpiece was prepared from the steel bar, and the mechanical properties of the steel bar were examined. From these tests, the relationship between the carbon content of the steel and the tensile strength shown in FIG. 2, and the relationship between the carbon content of the steel and the impact value shown in FIG. 3 were obtained.

Since the mechanical parts to which the present invention is directed have a tensile strength of 70 to 110 kg/mm² and an impact value of 10 kg-m/cm² or more, i.e. that of the quenched and tempered material of SCM435 steel which is a typical steel having high toughness, it was found that the C content in the steel should be 0.15% or less, and the Cr+Mn content should be in the range of from 2.00% to 4.00%. The steel exhibits a tensile strength of 70 to 110 kg/mm² and an impact value of 10 kg-m/cm² or more, obtained by cooling the steel in hot water after hot-forging. Thus, the present invention was accomplished.

EXAMPLES

EXAMPLE 1

The effect of the present invention will be further illustrated with reference to the following examples.

500 kg of each of steels having the chemical composition indicated in Table 1 were melted in a vacuum melting furnace and the melts were cast into ingots. The ingots were subjected to forging to provide steel bars 90 mm square. The steel bars were subjected to hot-forging to provide front wheel shafts of an automobile, and the shafts were allowed to cool on a conveyor at an average cooling rate of 25° C./min in the temperature range of from 800° C. to 400° C. Tensile testing specimens and impact testing specimens were prepared from the front wheel shaft and the mechanical properties of the shafts were examined. The results are shown in Table 2. It is apparent from Table 2 that the steels Nos. 1 to 5, which are the steels of the present invention, exhibit a tensile strength of 70 to 100 kg/mm$^2$ and high toughness of from 7 to 11 kg·m/cm$^2$ at 25° C.

Comparative Example no. 6 exhibited a tensile strength of more than 100 kg/mm$^2$. In comparative Example No. 7, titanium and boron were not added and the strength is poor.

TABLE 1

| | Chemical Composition of Tested Steels | | | | | | | | | | | |
|---|---|---|---|---|---|---|---|---|---|---|---|---|
| No. | C | Si | Mn | P | S | Cr | Al | Ti | B | N | Cr + Mn | Remarks |
| 1 | 0.11 | 0.25 | 1.91 | 0.015 | 0.020 | 1.10 | 0.019 | 0.019 | 0.0019 | 0.0041 | 3.01 | Invention |
| 2 | 0.17 | 0.19 | 1.80 | 0.016 | 0.044 | 0.80 | 0.028 | 0.021 | 0.0015 | 0.0050 | 2.60 | Comparative |
| 3 | 0.09 | 0.26 | 2.80 | 0.020 | 0.051 | 0.67 | 0.044 | 0.017 | 0.0010 | 0.0055 | 3.47 | Invention |
| 4 | 0.14 | 0.20 | 1.93 | 0.017 | 0.055 | 0.92 | 0.030 | 0.023 | 0.0016 | 0.0047 | 2.85 | " |
| 5 | 0.08 | 0.88 | 1.48 | 0.014 | 0.021 | 1.40 | 0.033 | 0.018 | 0.0022 | 0.0039 | 2.88 | " |
| 6 | 0.20 | 0.25 | 1.50 | 0.017 | 0.019 | 1.00 | 0.029 | 0.020 | 0.0022 | 0.0040 | 2.50 | Comparative |
| 7 | 0.08 | 0.24 | 1.45 | 0.015 | 0.022 | 1.50 | 0.025 | — | — | 0.0041 | 2.95 | " |

TABLE 2

| | Mechanical Properties | | | | | | |
|---|---|---|---|---|---|---|---|
| No. | Yield Strength (*) (kg/mm$^2$) | Tensile Strength (*) (kg/mm$^2$) | Elongation (*) (%) | Reduction of Area (*) (%) | Impact Value (**) (kg-m/cm$^2$) −50° C. | Impact Value (**) (kg-m/cm$^2$) 25° C. | Remarks |
| 1 | 62.1 | 88.9 | 20.0 | 63.1 | 6.9 | 11.8 | Invention |
| 2 | 68.7 | 96.8 | 18.3 | 48.5 | 4.3 | 7.0 | Comparative |
| 3 | 67.1 | 93.2 | 19.4 | 45.4 | 5.5 | 7.7 | Invention |
| 4 | 67.5 | 93.7 | 19.0 | 43.0 | 4.9 | 9.0 | " |
| 5 | 52.0 | 73.0 | 28.9 | 65.1 | 7.9 | 16.1 | " |
| 6 | 75.5 | 107.8 | 14.3 | 30.1 | 3.3 | 5.5 | Comparative |
| 7 | 48.0 | 66.8 | 30.1 | 66.1 | 8.2 | 17.2 | " |

(*) JIS No. 4 Tensile Test Specimen
(**) JIS No. 3 Impact Test Specimen

EXAMPLE 2

The effect of the present invention will be further illustrated with reference to the following examples.

Steels having the chemical composition indicated in Table 3 were melted and the melts were processed to steel bars having a diameter of 70 mm by a conventional method. The steel bars were heated to 1250° C. and were then subjected to hot-forging to provide shafts 35 mm in diameter. Immediately after the forging was completed, the shafts were cooled in hot water. Tensile testing specimens and impact testing specimens were prepared from the shaft and the material quality of the shafts were investigated. The results are shown in Table 4.

It is apparent from Table 4 that the material of the present invention exhibits a tensile strength of 70 to 110 kg/mm$^2$ and a high impact value of 10 kg-m/cm$^2$ or more. In the table, the shaft No. 13 has a high impact value, but the tensile strength is too high, and the tensile strength of the shaft No. 14 is too low.

TABLE 3

| | Chemical Composition of Tested Steels (wt %) | | | | | | | | | | | |
|---|---|---|---|---|---|---|---|---|---|---|---|---|
| No. | C | Si | Mn | P | S | Cr | Ti | B | Al | N | Mn + Cr | Remarks |
| 8 | 0.06 | 0.61 | 1.80 | 0.022 | 0.020 | 1.69 | 0.015 | 0.0009 | 0.022 | 0.0044 | 3.49 | Invention |
| 9 | 0.10 | 0.20 | 1.60 | 0.019 | 0.025 | 1.00 | 0.020 | 0.0014 | 0.033 | 0.0051 | 2.60 | |
| 10 | 0.11 | 0.44 | 1.66 | 0.016 | 0.055 | 1.70 | 0.019 | 0.0018 | 0.019 | 0.0030 | 3.36 | |
| 11 | 0.12 | 0.48 | 0.75 | 0.020 | 0.028 | 2.30 | 0.024 | 0.0009 | 0.041 | 0.0041 | 3.05 | |
| 12 | 0.14 | 0.30 | 0.80 | 0.022 | 0.015 | 1.69 | 0.028 | 0.0021 | 0.021 | 0.0045 | 2.49 | |
| 13 | 0.10 | 0.23 | 1.89 | 0.015 | 0.019 | 2.21 | 0.019 | 0.0022 | 0.030 | 0.0053 | 4.10 | Comparative |
| 14 | 0.12 | 0.22 | 1.00 | 0.021 | 0.021 | 0.89 | 0.022 | 0.0009 | 0.020 | 0.0040 | 1.89 | |
| 15 | 0.19 | 0.21 | 1.11 | 0.017 | 0.020 | 1.44 | 0.018 | 0.0015 | 0.039 | 0.0031 | 2.55 | |

TABLE 4

| | Mechanical Properties | | | | | | | |
|---|---|---|---|---|---|---|---|---|
| No. | Yield Strength (*) (kg/mm$^2$) | Tensile Strength (*) (kg/mm$^2$) | Elongation (*) (%) | Reduction of Area (%) | Hardness (Hv) | Impact Value (**) (kg-m/cm$^2$) −50° C. | Impact Value (**) (kg-m/cm$^2$) 25° C. | Remarks |
| 8 | 56.6 | 82.1 | 23.1 | 65.3 | 260 | 11.3 | 16.9 | Invention |
| 9 | 53.6 | 75.5 | 29.9 | 69.8 | 235 | 7.0 | 12.5 | |
| 10 | 75.3 | 109.0 | 17.2 | 43.3 | 341 | 6.5 | 13.0 | |
| 11 | 67.4 | 97.0 | 19.2 | 59.3 | 300 | 5.5 | 11.5 | |
| 12 | 64.6 | 91.0 | 19.1 | 59.9 | 277 | 4.9 | 10.5 | |

TABLE 4-continued

| No. | Yield Strength (*) (kg/mm²) | Tensile Strength (*) (kg/mm²) | Mechanical Properties: Elongation (*) (%) | Reduction of Area (%) | Hardness (Hv) | Impact Value (**) (kg-m/cm²) −50° C. | 25° C. | Remarks |
|---|---|---|---|---|---|---|---|---|
| 13 | 86.9 | 123.0 | 12.0 | 36.0 | 381 | 7.1 | 13.9 | Comparative |
| 14 | 47.0 | 68.3 | 30.1 | 68.3 | 208 | 7.1 | 12.1 | |
| 15 | 83.8 | 118.0 | 13.1 | 38.9 | 366 | 4.3 | 7.0 | |

(*) JIS No. 4 Tensile Test Specimen
(**) JIS No. 3 Impact Test Specimen

The non-heat treated steel of the present invention (Example 1) which had been merely allowed to cool without being subjected to heat treatment after hot-forging can be formed into mechanical parts having tensile strength of 70 to 100 kg/mm² and improved toughness at a relatively low cost. These mechanical parts can be used as important safety-preservation parts of automobiles such as the suspension and associated members thereof.

The non-heat treated steel of the present invention (Example 2) has material properties of tensile strength of 70 to 110 kg/mm² and improved toughness of 10 kg-m/cm² or more by being cooled in hot water without being subjected to quenching and tempering treatments after hot-forging. Therefore, such steel can also be used as a material for producing important safety-preservation parts of automobiles such as the suspension and associated members thereof.

We claim:

1. Non-heat treated steel bar consisting of, by weight percentage:

C: 0.05%-less than 0.15%,
Si: 0.10%-1.00%,
Mn: 0.50%-3.00%,
Cr: at least 0.67% Cr with Cr plus Mn being 1.60%-4.20%,
Ti: 0.010%-0.030%,
B: 0.0005%-0.0030%,
Al: 0.010%-0.05%,
N: not more than 0.0060%, and the balance consisting essentially of iron; and said steel bar has a tensile strength of from 70 to 100 kg/mm² and improved toughness in terms of 5 kg-m/cm² or more of impact value, as well as bainite matrix, said steel bar having been hot-forged and cooled in still air, without any subsequent step of being quenched and tempered.

2. Non-heat treated steel bar consisting of, by weight percentage:

C: 0.05%-less than 0.15%,
Si: 0.10%-1.00%,
Mn: 0.50%-3.00%,
Cr: at least 0.67% Cr with Cr plus Mn being 1.60%-4.20%,
Ti: 0.010%-0.030%,
B: 0.0005%-0.0030%,
Al: 0.010%-0.05%,
N: not more than 0.006%, and the balance consisting essentially of iron; said steel bar has a tensile strength of from 70 to 110 kg/mm² and improved toughness in terms of 10 kg-m/cm² or more of impact value, as well as bainite matrix, said steel bar having been hot-forged and cooled in hot water, without any subsequent step of being quenched and tempered.

* * * * *